US008086154B2

(12) United States Patent
Law et al.

(10) Patent No.: US 8,086,154 B2
(45) Date of Patent: Dec. 27, 2011

(54) NANOMATERIAL HEATING ELEMENT FOR FUSING APPLICATIONS

(75) Inventors: Kock-Yee Law, Penfield, NY (US); Hong Zhao, Webster, NY (US); Bryan Roof, Newark, NY (US); Michael F. Zona, Holley, NY (US); David J. Gervasi, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 568 days.

(21) Appl. No.: 12/257,015

(22) Filed: Oct. 23, 2008

(65) Prior Publication Data

US 2010/0104332 A1 Apr. 29, 2010

(51) Int. Cl.
*G03G 15/20* (2006.01)

(52) U.S. Cl. ..... 399/282; 399/333

(58) Field of Classification Search ..... 399/328, 399/333; 347/88

See application file for complete search history.

(56) References Cited

U.S. PATENT DOCUMENTS

| | | | | |
|---|---|---|---|---|
| 6,344,272 | B1 | 2/2002 | Oldenburg et al. | |
| 2005/0170089 | A1 | 8/2005 | Lashmore et al. | |
| 2006/0292360 | A1 * | 12/2006 | Hays et al. | 428/323 |
| 2007/0036709 | A1 | 2/2007 | Lashmore et al. | |
| 2009/0160920 | A1 * | 6/2009 | Badesha et al. | 347/88 |

FOREIGN PATENT DOCUMENTS

| | | | |
|---|---|---|---|
| JP | 2007304374 A | * | 11/2007 |
| JP | 2008180965 A | * | 8/2008 |

OTHER PUBLICATIONS

Computer Translation of JP2008-180965A, Aug. 7, 2008 to Kusumoto.*

Puech et al., "Ultraviolet Photon Absorption in Single- and Double-Wall Carbon Nanotubes and Peapods: Heating-Induced Photon Line Broadening, Wall Coupling, and Transformation", The American Physical Society, 2007, pp. 054118-1 thru 054118-4.

Zhang et al., "Temperature Dependence of the Raman Spectra of Single-Wall Carbon Nanotubes", Applied Physics Letters, vol. 76 No. 15, Apr. 10, 2000, pp. 2053-2055.

Venkateswaran et al., "Probing the Single-Wall Carbon Nanotube Bundle: Rama Scattering Under High Pressure", Physical Review B, vol. 59 No. 16, Apr. 15, 1999, pp. 10928-10934.

(Continued)

*Primary Examiner* — Quana M Grainger
(74) *Attorney, Agent, or Firm* — MH2 Technology Law Group LLP

(57) ABSTRACT

In accordance with the invention, there are printing apparatuses and methods of forming an image. An exemplary printing apparatus can include a fuser subsystem including one or more light induced heating elements, each of the one or more light induced heating elements including plurality of nanomaterials, wherein the nanomaterials are selected from the group consisting of carbon nanotubes and metal nanoshells. The exemplary printing apparatus can also include one or more light sources disposed in close proximity to the one or more light induced heating elements, each of the one or more light sources having an emission in the absorption range of the plurality of nanomaterials and disposed to produce heat in the fuser subsystem by light absorption by the plurality of nanomaterials.

25 Claims, 9 Drawing Sheets

OTHER PUBLICATIONS

Ajayan et al., "Nanotubes in a Flash—Ignition and Reconstruction", Science, vol. 296, Apr. 26, 2002, p. 705.

Raravikar et al., "Temperature Depencence of Radial Breathing Mode Raman Frequency of Single-Walled Carbon Nanotubes", Physical Review B 66, 2002, pp. 235424-1 thru 235424-9.

Bassil et al., "Controlled Laser Heating of Carbon Nanotubes", Applied Physics Letters 88, 2006, pp. 173113-1 thru 173113-3.

Liu et al., "Laser-Induced High Local Temperature in Carbon Nanotube", Solid State Phenomena, vols. 121-123, 2007, pp. 331-335 (Abstract Only).

Liu et al., "Laser-Induced High Local Temperature in Carbon Nanotube", Solid State Phenomena, vols. 121-123, 2007, pp. 331-335 (Full Article).

* cited by examiner

NANOMATERIAL HEATING ELEMENT FOR FUSING APPLICATIONS

DESCRIPTION OF THE INVENTION

1. Field of the Invention

The present invention relates to printing and marking devices and more particularly to fuser subsystems and methods of using them.

2. Background of the Invention

Current fusing systems in marking (dry and direct) are very inefficient in regards to energy consumption. For example, in a typical fuser roll, only about 1% of the heat is used to fix the toner images, the rest is split between warming up the paper and simply waste due to heating up the roll and during standby. Also, as a result of the large heating mass, the warm up time can be very long, for example, up to about 30 minutes for large production machines.

Accordingly, there is a need to overcome these and other problems of prior art to provide fusing subsystems that can address all three concerns in, warm up time, energy efficiency, and heat addressability.

SUMMARY OF THE INVENTION

In accordance with various embodiments, there is a printing apparatus. The printing apparatus can include a fuser subsystem including one or more light induced heating elements, each of the one or more light induced heating elements including a plurality of nanomaterials, wherein the nanomaterials are selected from the group consisting of carbon nanotubes and metal nanoshells. The printing apparatus can also include one or more light sources disposed in close proximity to the one or more light induced heating elements, each of the one or more light sources having an emission in the absorption range of the plurality of nanomaterials and disposed to produce heat in the fuser subsystem by light absorption by the plurality of nanomaterials.

According to various embodiments, there is a method of forming an image. The method can include providing a toner image on a media and providing a fuser subsystem that produces heat in one or more light induced heating elements by absorption of light by a plurality of nanomaterials, wherein the nanomaterials are selected from the group consisting of carbon nanotubes and metal nanoshells. The method can also include providing one or more light sources in close proximity to the one or more light induced heating elements, each of the one or more light sources having emission in the absorption range of the plurality of nanomaterials. The method can further include feeding the media through the fuser subsystem and fixing the toner image onto the media by exposing light using the one or more light sources on the one or more light induced heating elements to heat the one or more light induced heating elements and the fuser subsystem in contact with the media by light absorption by the plurality of nanomaterials.

According to yet another embodiment, there is a marking method. The marking method can include feeding a media in a marking system, the marking system including a fuser subsystem that produces heat in one or more light induced heating elements by absorption of light by a plurality of nanomaterials, wherein the nanomaterials are selected from the group consisting of carbon nanotubes and metal nanoshells. The marking method can also include providing one or more light sources in close proximity to the one or more light induced heating elements, each of the one or more light sources having emission in the absorption range of the plurality of nanomaterials. The marking method can further include transferring and fusing an image onto the media by exposing light using the one or more light sources on the one or more light induced heating elements to heat the one or more light induced heating elements and the fuser subsystem that correspond to the toner image and transporting the media to a finisher.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

Figure 1:
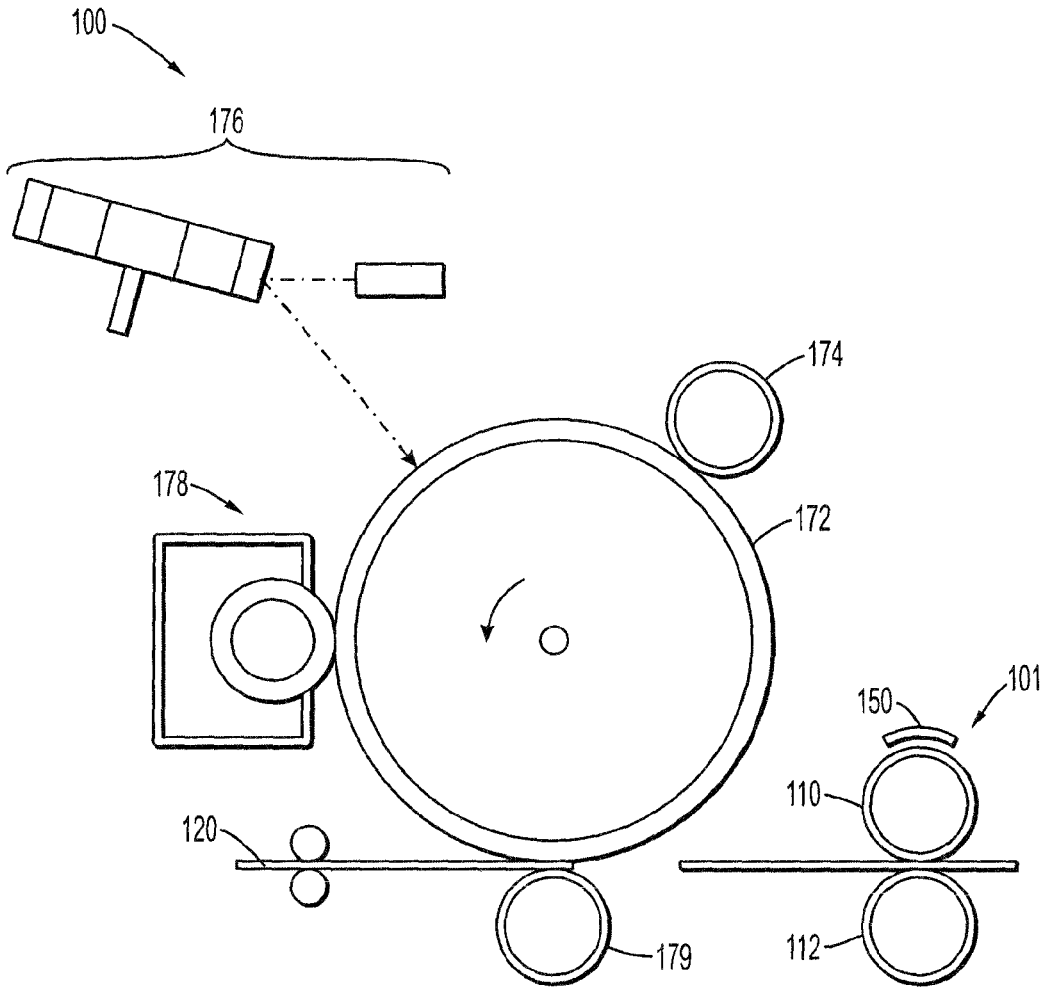
FIG. 1 schematically illustrates an exemplary printing apparatus, according to various embodiments of the present teachings.

FIG. 1 schematically illustrates an exemplary printing apparatus 100. The exemplary printing apparatus 100 can include an electrophotographic photoreceptor 172 and a charging station 174 for uniformly charging the electrophotographic photoreceptor 172. The electrophotographic photoreceptor 172 can be a drum photoreceptor as shown in FIG. 1 or a belt photoreceptor (not shown). The exemplary printing apparatus 100 can also include an imaging station 176 where an original document (not shown) can be exposed to a light source (also not shown) for forming a latent image on the electrophotographic photoreceptor 172. The exemplary printing apparatus 100 can further include a development subsystem 178 for converting the latent image to a visible image on the electrophotographic photoreceptor 172 and a transfer subsystem 179 for transferring the visible image onto a media 120. The printing apparatus 100 can also include a fuser subsystem 101 for fixing the visible image onto the media 120. The fuser subsystem 101 can include one or more light induced heating elements 106, wherein each of the one or more light induced heating elements 106 can include a plurality of nanomaterials 105, wherein the nanomaterials 105 are selected from the group consisting of carbon nanotubes and metal nanoshells.

In various embodiments, the plurality of nanomaterials 105 can include one or more of a plurality of single wall carbon nanotubes (SWNT), a plurality of double wall carbon nanotubes (DWNT), and a plurality of multiple wall carbon nanotubes (MWNT). In some embodiments, carbon nanotubes can be one or more of semiconducting carbon nanotubes and metallic carbon nanotubes. Furthermore, the carbon nanotubes can be of different lengths, diameters, and/or chiralities. The carbon nanotubes can have a diameter from about 0.5 nm to about 20 nm and length from about 100 nm to a few mm. In certain embodiments, each of the plurality of nanomaterials 105 can include a metal nanoshell 405', as shown in FIG. 9B. The metal nanoshell 405' can include a dielectric core 492 and a metal shell 491 disposed over the dielectric core 492. In some embodiments, the metal in the metal shell 491 can be selected from the group consisting of gold, silver, and copper. In other embodiments, the dielectric core 492 can be selected from the group consisting of silica, titania, and alumina. The dielectric core 491 in the metal nanoshell 405' can have a diameter from about 30 nm to about 150 nm and in some cases from about 50 nm to 70 nm with metal shell 491 having a thickness from about 5 nm to about 25 nm and in some cases from about 10 nm to about 15 nm. U.S. Pat. No. 6,344,272 describes in detail the design and the fabrication methodology of the metal nanoshells 405', the disclosure of which is incorporated by reference herein in its entirety.

Referring back to the FIG. 1, the exemplary printing apparatus 100 can further include one or more light sources 150 disposed in close proximity to the one or more light induced heating elements 106, each of the one or more light sources 150 having an emission in the absorption range of the plurality of nanomaterials 105 and disposed to produce heat in the fuser subsystem 101 by light absorption by the plurality of nanomaterials 105. In various embodiments, the one or more light induced heating elements 106 can achieve a temperature in the range of about 100° C. to about 200° C. upon exposure of light by the light source 150 and can go to a desired lower temperature rapidly upon removal of the light exposure, wherein the desired lower temperature is less than the temperature achieved by the one or more light induced heating elements 106 upon exposure of light. The time taken to reach desired temperature and to return to ambient temperature depends on several factors, such as, for example, light source, spectral power distribution of the light source, intensity of the light source, and process speed.

In various embodiments, the light source 150 can include at least one of a UV lamp, a xenon lamp, a halogen lamp, a laser array, a light emitting diode (LED) array, and an organic light emitting diode (OLED) array. The light source 150 can emit light anywhere from ultraviolet to near infrared region. In certain embodiments, the light source 150 can be a digital light source, wherein each light component of the at least one of the laser array, the light emitting diode (LED) array, and the organic light emitting diode (OLED) array can be individually addressable. The term "light component" as used herein refers to an LED of the LED array, an OLED of the OLED array or a laser of the Laser array. The phrase "individually addressable" as used herein means that each light component such as an LED of the LED array can be identified and manipulated independently of its surrounding LEDs, for example, each LED can be individually turned on or off and output of each LED can be controlled individually. However in some embodiments, instead of addressing each light component such as, for example, an LED of the LED array individually, a group of LEDs including two or more LEDs can be addressed together, i.e a group of LEDs of the LED array can be turned on or off together. For example, in case of printing text with a certain line spacing and margins, the light components, such as for example one or more LEDs of the LED array corresponding to the text can be turned on to selectively expose light on those portions of the one or more light induced heating elements that correspond to the text, but the LEDs corresponding to the line spacing between the text and the margins around the text can be turned off. Hence, with a digital light source, the one or more light induced heating elements can be a digital heat source.

Figure 3:
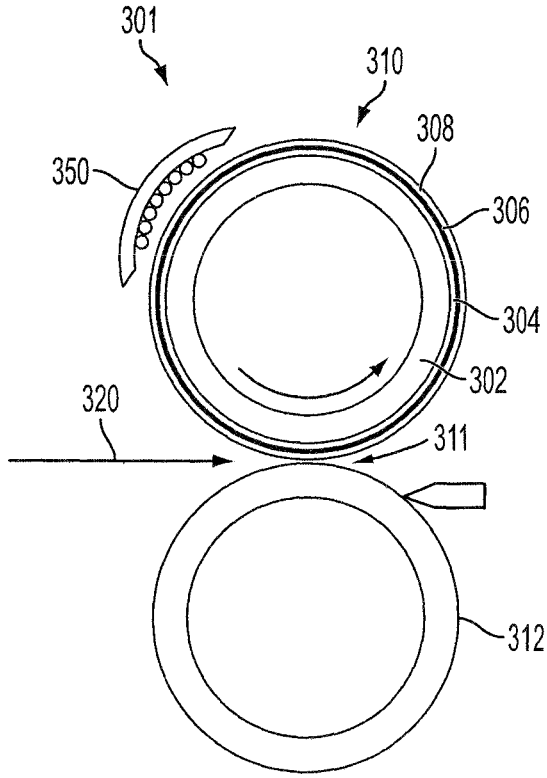
FIG. 3 schematically illustrates an exemplary fuser subsystem of a printing apparatus, according to various embodiments of the present teachings.
Figure 4:
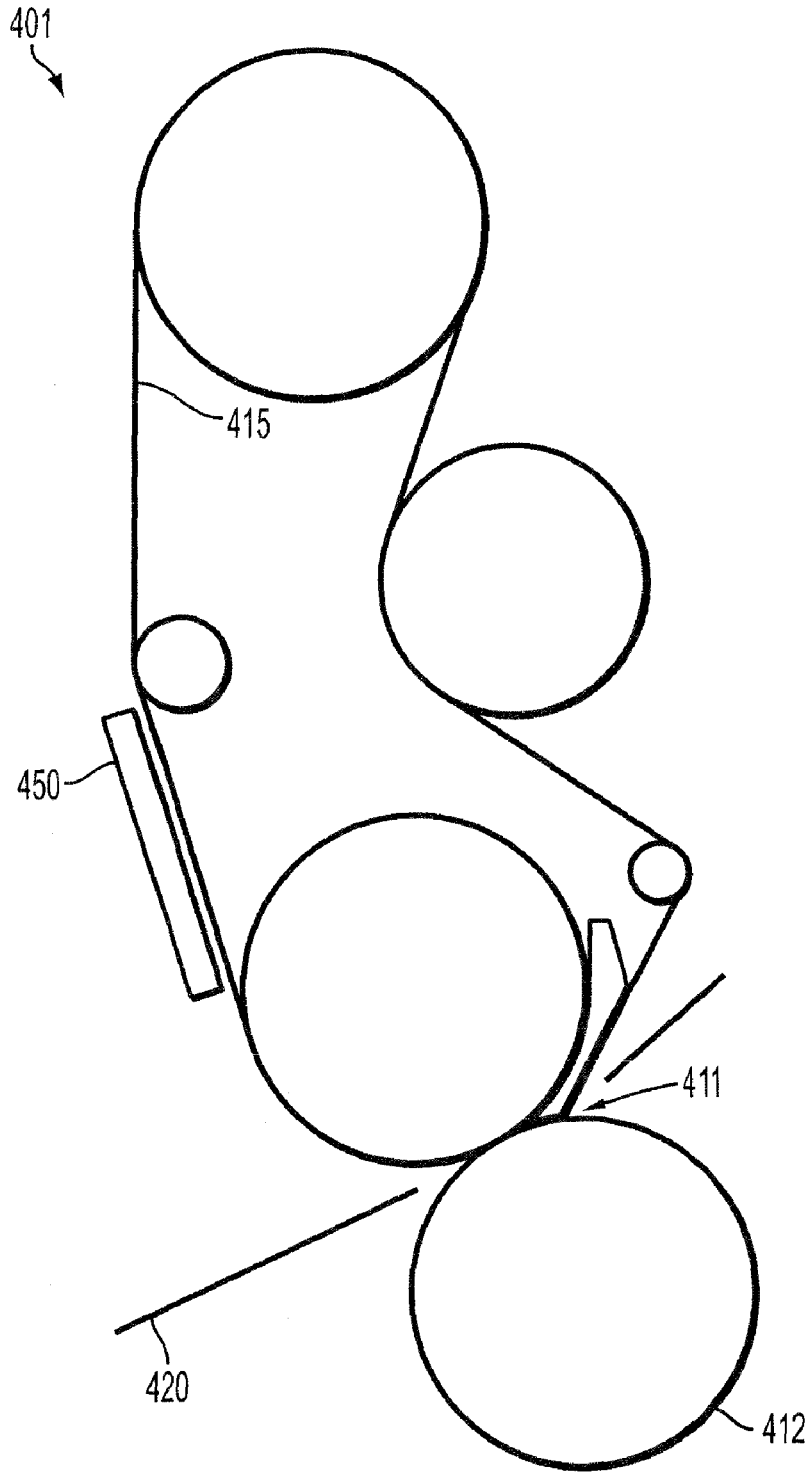
FIG. 4 schematically illustrates another exemplary fuser subsystem of a printing apparatus, according to various embodiments of the present teachings.
Figure 7:
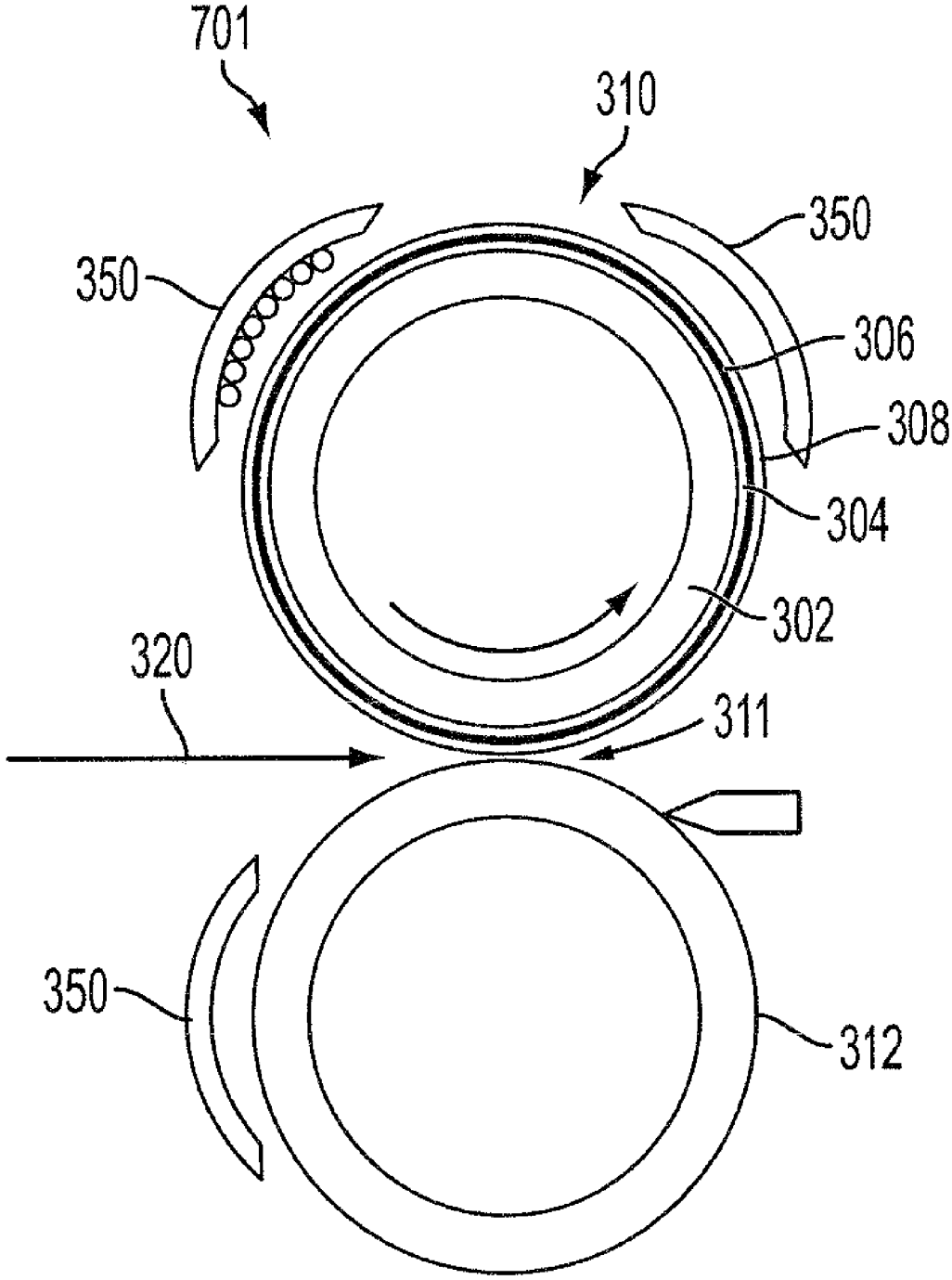
FIG. 7 schematically illustrates an exemplary fuser subsystem of a printing apparatus, according to various embodiments of the present teachings.
Figure 8:
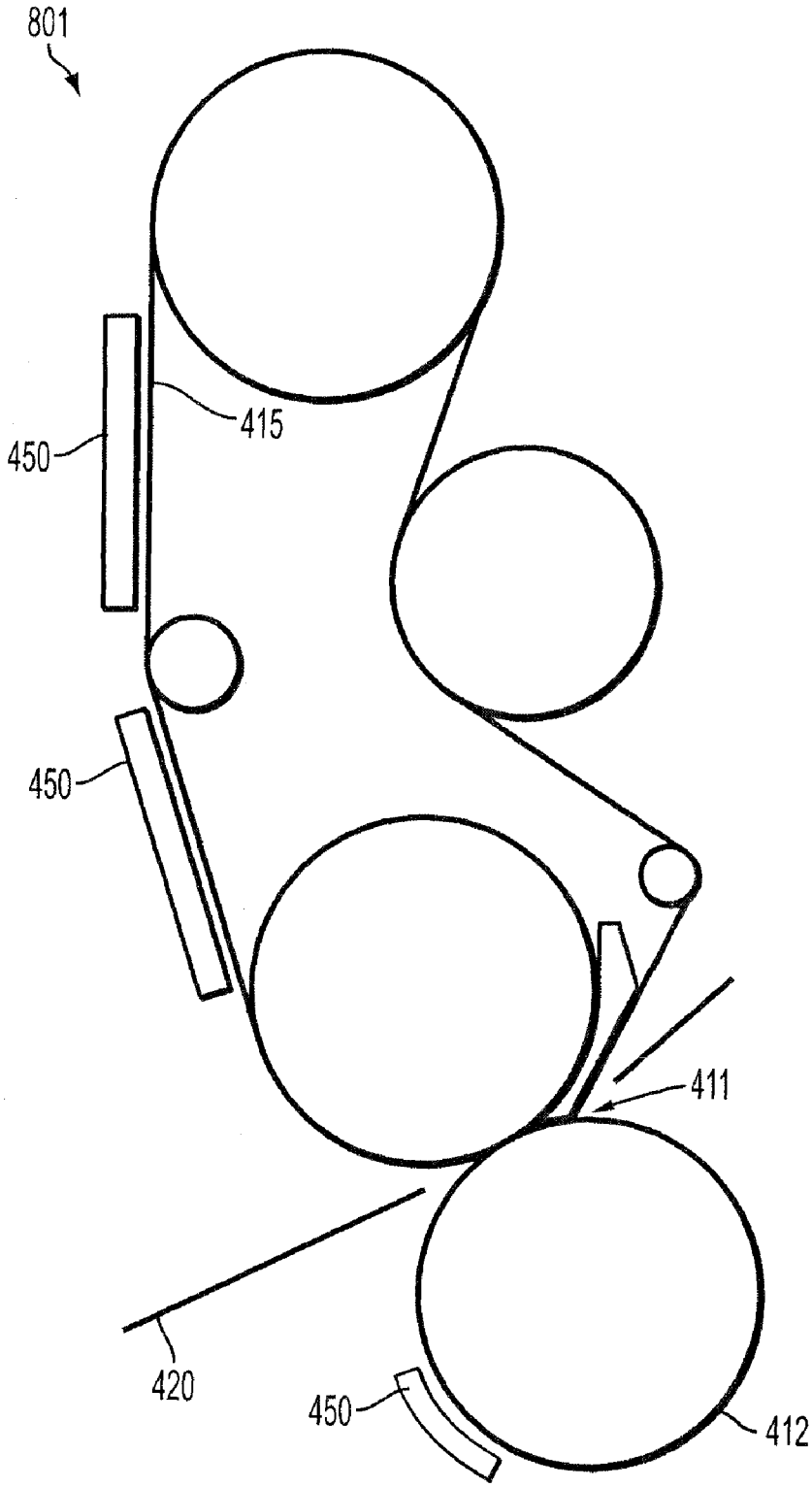
FIG. 8 schematically illustrates another exemplary fuser subsystem of a printing apparatus, according to various embodiments of the present teachings.

The fuser subsystem 101 of the printing apparatus 100 can include one or more of a fuser member 110, a pressure member 112, oiling subsystems (not shown), and a cleaning web (not shown). In some embodiments, the fuser member 110 can be a fuser roll 110, 310, as shown in FIGS. 1, 3, and 7. In other embodiments, the fuser member 110 can be a fuser belt, 415, as shown in FIGS. 4 and 8. In various embodiments, the pressure member 112 can be a pressure roll 112, 312, 412, as shown in FIGS. 1, 3, 4, and 8 or a pressure belt (not shown).

Figure 2:
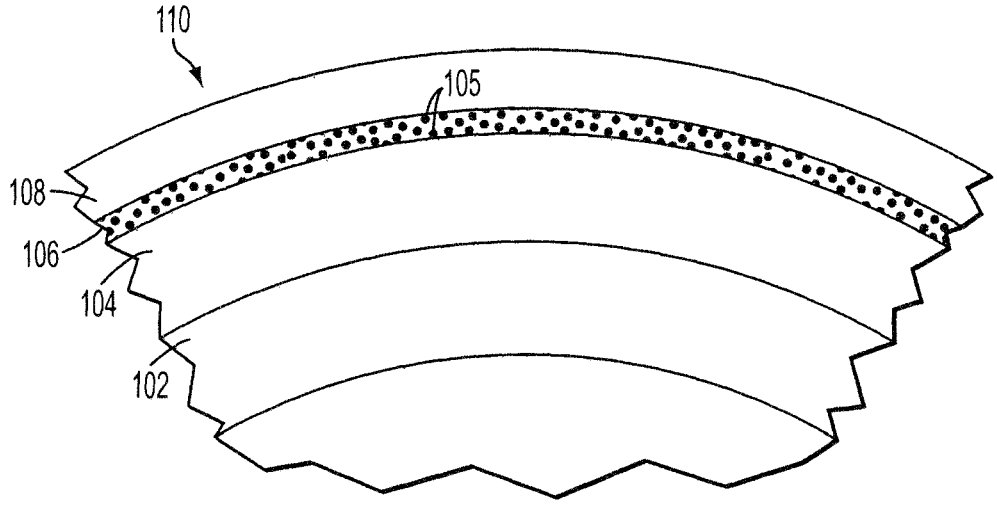
FIG. 2 schematically illustrates a cross section of an exemplary fuser member shown in FIG. 1, according to various embodiments of the present teachings.

FIG. 2 schematically illustrates a cross section of an exemplary fuser member 110, 310, 415. The exemplary fuser member 110 can include a conformance layer 104 disposed over a substrate 102. In some embodiments, the substrate 102 can be a high temperature plastic substrate, such as, for example, polyimide, polyphenylene sulfide, polyamide imide, polyketone, polyphthalamide, polyetheretherketone (PEEK), polyethersulfone, polyetherimide, and polyaryletherketone. In other embodiments, the substrate 102 can be a metal substrate, such as, for example, steel and aluminum. The thickness of the substrate 102 in a belt configuration can be from about 50 μm to about 150 μm, and in some cases from about 65 μm to about 85 μm. The thickness of the substrate 102 in a roll configuration can be from about 2 mm to about 20 mm, and in some cases from about 5 mm to about 15 mm. In various embodiments, the conformance layer 104 can also be a thermal barrier layer. The conformance layer 104 can be made of any suitable material, such as, for example, silicone rubber, fluorosilicone, and fluoroelastomer. The exemplary fuser member 110 can also include light induced heating element layer 106 including a plurality of nanomaterials 105 disposed over the conformance layer 104 and a toner release layer 108 disposed over the light induced heating element layer 106. In various embodiments, the light induced heating element layer 106 can include one or more of a plurality of single wall carbon nanotubes, a plurality of double wall carbon nanotubes, and a plurality of multiple wall carbon nanotubes. In some embodiments, the light induced heating element layer 106 can include a carbon nanotube textile. U.S. Patent Application Publication Nos. 2005/0170089 and 2007/0036709 describe in detail the method of making carbon nanotubes textile, the disclosures of which are incorporated by reference herein in their entirety. In other embodiments, the light induced heating element layer 106 can include a solvent coatable light absorbing carbon nanotubes layer. One of ordinary skill in the art would know that the solvent coatable light absorbing carbon nanotubes layer can be coated from an aqueous dispersion or an alcoholic dispersion of carbon nanotubes wherein the carbon nanotubes can be stabilized by a surfactant or a DNA or a polymeric material. Any suitable method can be used for coating the solvent coatable light absorbing carbon nanotubes layer over the conformance layer. In some other embodiments, the light induced heating element layer 106 can include a plurality of metal nanoshells 405' dispersed in a polymer, each of the plurality of metal nanoshells 405' including a dielectric core 492 and a metal shell 491 disposed over the dielectric core 492. Any suitable metal, such as, for example gold, silver, and copper can be used for the metal shell 491. Any suitable dielectric material, such as, for example, silica, titania, and alumina can be used for the dielectric core 492. In various embodiments, the light induced heating element layer 106 can have a thickness from about 0.1 μm to about 150 μm, and in some cases from about 40 μm to about 100 μm.

In certain embodiments, the toner release layer 108 can include any suitable material, such as, for example, silicone, fluorosilicone, fluoropolymer, and fluoroelastomer. The toner release layer 108 can have a thickness from about 10 μm to about 100 μm, and in some cases from about 20 μm to about 60 μm. In some cases, the toner release layer 108 can have about 10% to about 100% transparency and in other cases from about 50% to about 100% transparency in the absorption range of the plurality of nanomaterials 105. In various embodiments, one or more optional adhesive layers (not shown) can be used between the substrate 102 and the conformance layer 104, between the conformance layer 104 and the light induced heating element layer 106, and between the light induced heating element layer 106 and the toner release layer 108 to ensure that each layer 104, 106, 108 is bonded properly to each other and to meet performance target. In various embodiments, the pressure members 112, 312, 412 can also have a cross section as shown in FIG. 2 of an exemplary fuser member 110, 310, 415.

Referring back to the printing apparatus 100, the printing apparatus 100 can be a xerographic printer, as shown in FIG. 1. FIG. 3 schematically illustrates an exemplary fuser subsystem 301 of a xerographic printer. The exemplary fuser subsystem 301 as illustrated in FIG. 3 has a roll configuration and can include a fuser roll 310 and a rotatable pressure roll 312 that can be mounted forming a fusing nip 311. In various embodiments, one or more of fuser rolls 310 and pressure rolls 312 can include one or more light induced heating elements 306 including plurality of nanomaterials 105. In some embodiments, the one or more light induced heating elements 306 can include one or more of a plurality of single wall carbon nanotubes, a plurality of double wall carbon nanotubes, and a plurality of multiple wall carbon nanotubes. In other embodiments, the one or more light induced heating elements 306 can include a plurality of metal nanoshells. The one or more light induced heating elements 306 can be disposed over a conformance layer 304, the conformance layer 304 disposed over a substrate 302. In some embodiments, the substrate 302 can be a high temperature plastic substrate, such as, for example, polyimide, polyphenylene sulfide, polyamide imide, polyketone, polyphthalamide, polyetheretherketone (PEEK), polyethersulfone, polyetherimide, and polyaryletherketone. In other embodiments, the substrate 302 can be a metal substrate, such as, for example, steel and aluminum. A toner release layer 308 can be disposed over the one or more light induced heating elements 306, as shown in FIG. 3. In various embodiments, the one or more light induced heating elements 306 can be used as a heat source and can be disposed in the pressure roll 312 in a configuration similar to that for the fuser member 310, 110. The exemplary fuser subsystem 301 can also include one or more light sources 350 disposed in close proximity to the one or more light induced heating elements 306. FIG. 3 shows an exemplary fuser subsystem 301 including one light source 350, whereas FIG. 7 shows an exemplary fuser subsystem 701 including a plurality of light sources 350. A media 320 carrying an unfused toner image can be fed through the fusing nip 311 for fusing. The exemplary fuser subsystem 301 can also include an oiling subsystem (not shown) to oil the surface of the fuser member 310 to ease the removal of residual toner and external heat rolls (not shown) to provide additional heat source and cleaning subsystem (not shown). In various embodiments, the one or more light induced heating elements 306 in the fuser roll 310 and/or the pressure roll 312 can be a digital heat source, wherein each light component of the light source can be digital and individually addressable and thereby creating heat digitally.

FIG. 4 schematically illustrates an exemplary fuser subsystem 401 in a belt configuration of a xerographic printer. The exemplary fuser subsystem 401 can include a fuser belt 415 and a rotatable pressure roll 412 that can be mounted forming a fusing nip 411. In various embodiments, one or more of fuser belts 415 and pressure rolls 412 can include one or more light induced heating elements 206 including a plurality of nanomaterials 105, as shown in FIG. 2. The exemplary fuser subsystem 401 can also include one or more light sources 450 disposed in close proximity to the one or more light induced heating elements. FIG. 4 shows an exemplary fuser subsystem 401 including one light source 450, whereas FIG. 8 shows an exemplary fuser subsystem 801 including a plurality of light sources 450.

Figure 9:
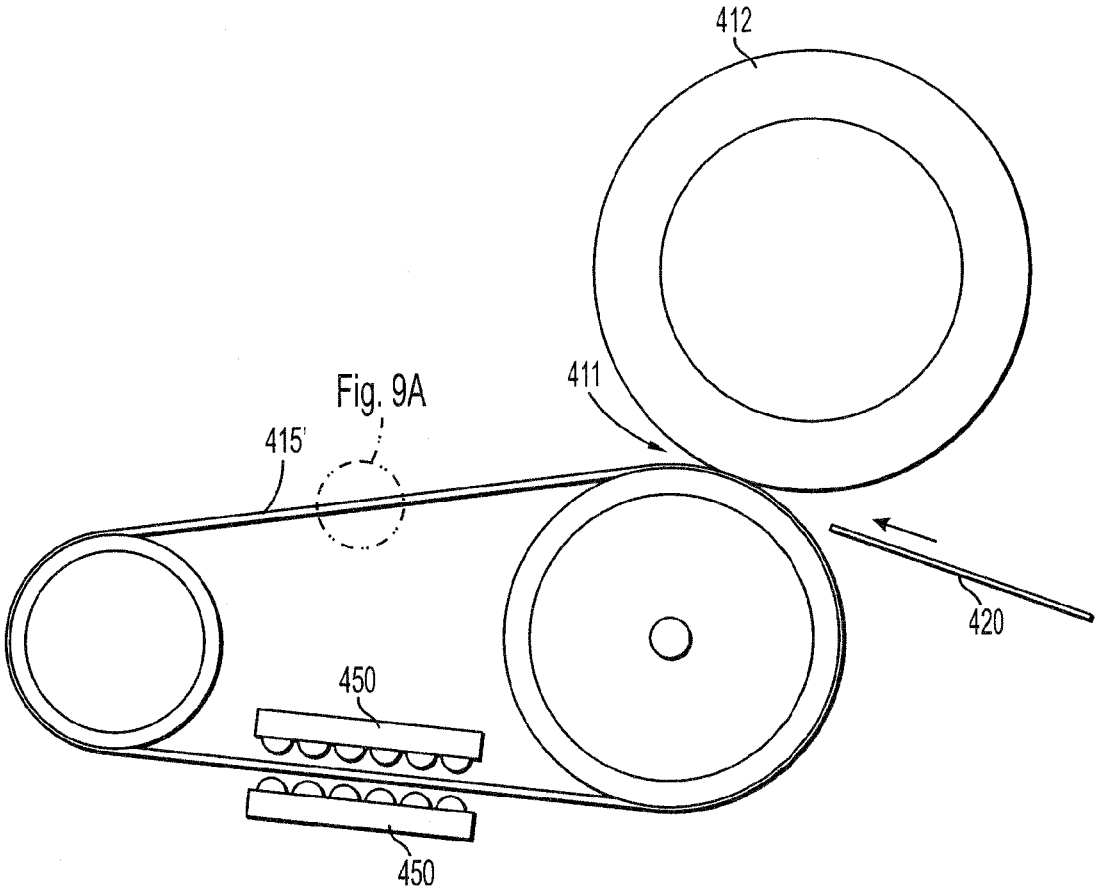
FIG. 9 schematically illustrates another exemplary fuser subsystem of a printing apparatus, according to various embodiments of the present teachings.
Figure 9A:
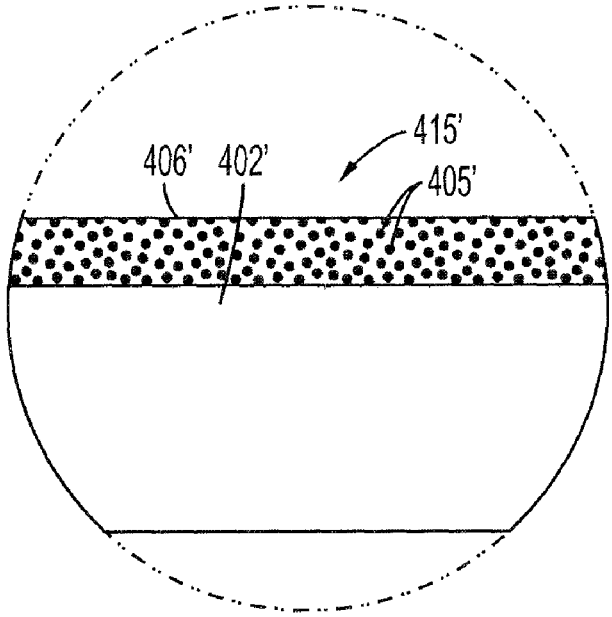
FIG. 9A schematically illustrates a cross section of an exemplary fuser member shown in FIG. 9, according to various embodiments of the present teachings.
Figure 9B:
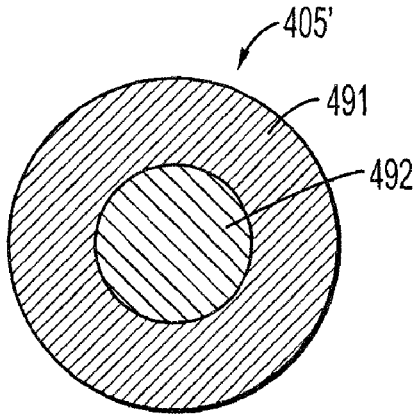
FIG. 9B schematically illustrates a metal nanoshell, according to various embodiments of the present teachings.

FIG. 9 shows another exemplary fuser subsystem 901 including a fuser belt 415' and a rotatable pressure roll 412 that can be mounted forming a fusing nip 411. In various embodiments, one or more of fuser belts 415' and pressure rolls 412 can include one or more light induced heating elements 406' including a plurality of nanomaterials 405', as shown in FIG. 9A. The fuser subsystem 901 can also include a plurality of light sources 450, wherein the light sources can be on either side of the fuser belt 415', as shown in FIG. 9. A media 420 carrying an unfused toner image can be fed through the fusing nip 411 for fusing. FIG. 9A schematically illustrates a cross section of the fuser belt 415'. The exemplary fuser belt 415' can include a light induced heating element layer 406' disposed over a substrate 402', wherein the light induced heating element layer 406' can include a plurality of metal nanoshells 405' dispersed in a polymer, wherein the light induced element layer 406' can also function as the toner release layer. The metal nanoshells 405' can be dispersed in any suitable fluoropolymer, such as, fluoropolymers, silicones and siloxanes, fluorosilicones, polyphosphazene, polyimide, polyamide, polyester, polycarbonate and others, as well as blends of the aforementioned polymers. The substrate 402' can be any suitable material that is translucent to the wavelength being used in the light source to heat the light induced heating element layer 406', such as, for example, silicones, siloxanes, fluorosilicones, polyphosphazene, polyimide, polyamide, polyester, polycarbonate and others, as well as blends of the aforementioned polymers.

Figure 5:
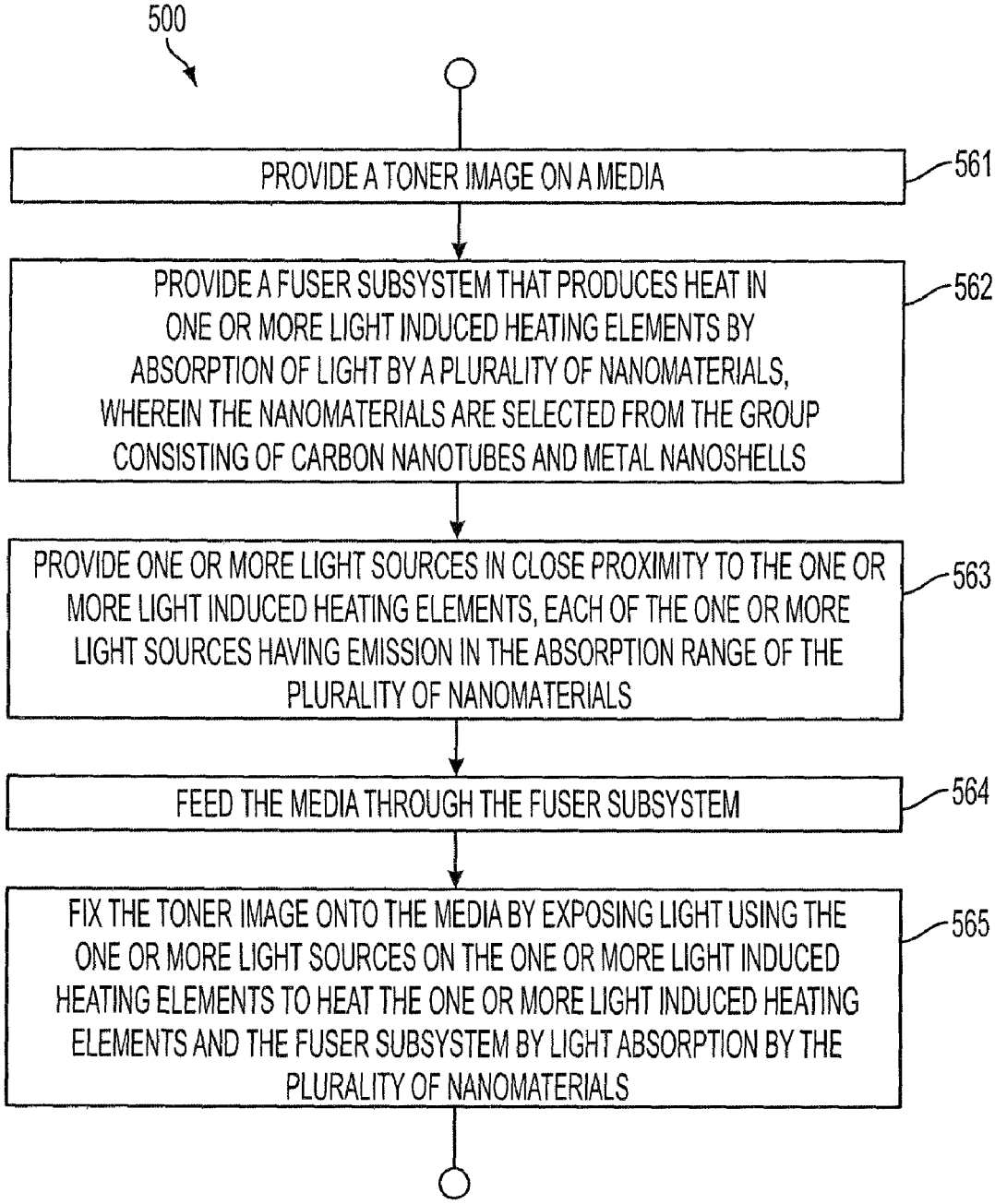
FIG. 5 shows an exemplary method of forming an image, according to various embodiments of the present teachings.
Figure 6:
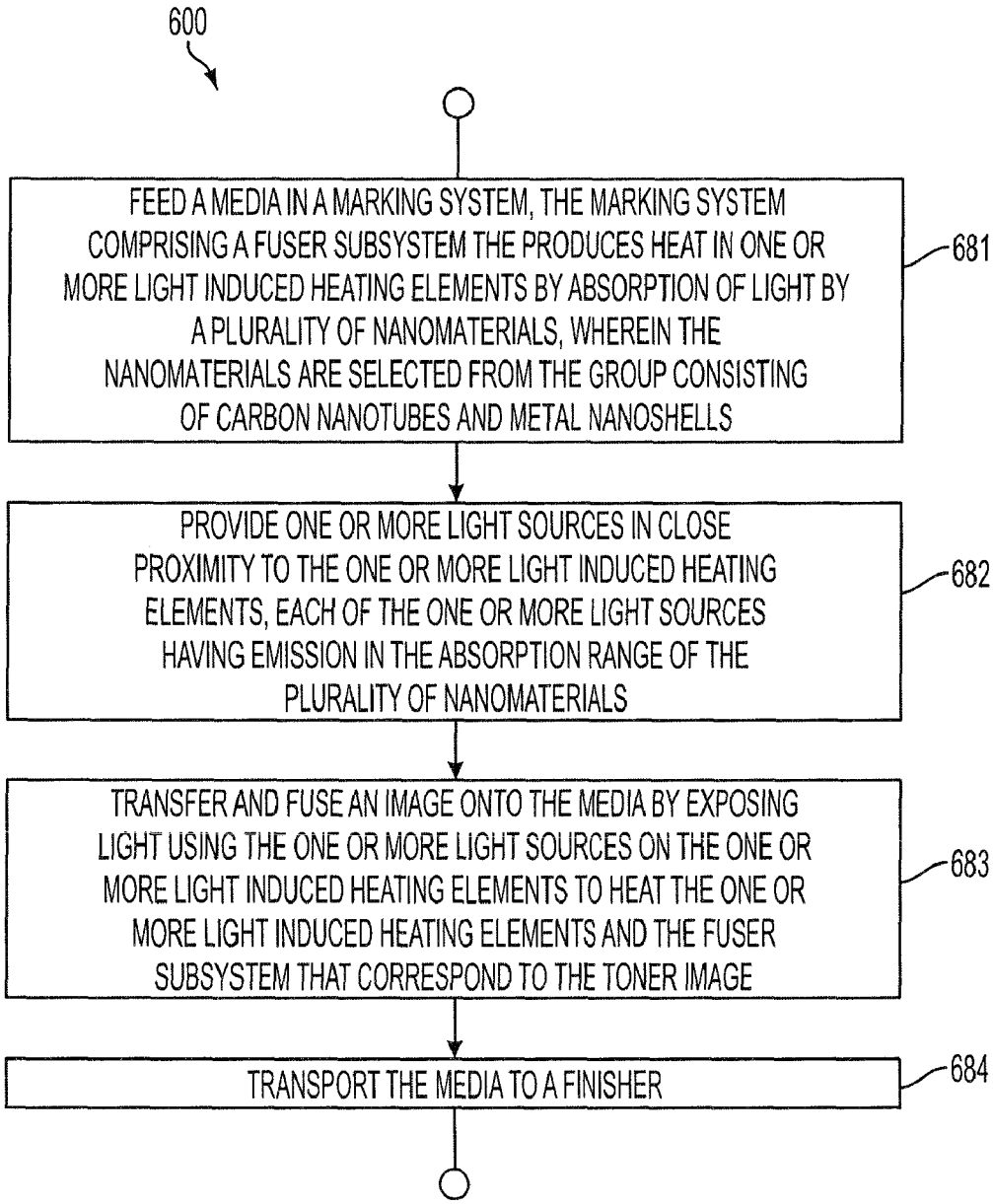
FIG. 6 shows an exemplary marking method, according to various embodiments of the present teachings.

According to various embodiments, there is a method 500 of forming an image, as shown in FIG. 5. The method 500 can include providing a toner image on a media, as in step 561. The method 500 can also include a step 562 of providing a fuser subsystem that produces heat in one or more light induced heating elements by absorption of light by a plurality of nanomaterials, wherein the nanomaterials are selected from the group consisting of carbon nanotubes and metal nanoshells, the metal nanoshell including a dielectric core and a metal shell over the dielectric core. In some embodiments, the step 562 of providing a fuser subsystem can include providing the fuser subsystem in a roller configuration. In other embodiments, the step 562 of providing a fuser subsystem can include providing the fuser subsystem in a belt configuration. In some other embodiments, the step 562 of providing a fuser subsystem can include providing one or more of a fuser roll, a fuser belt, a pressure roll, and a pressure belt. The method 500 can also include a step 563 of providing one or more light sources in close proximity to the one or more light induced heating elements, each of the one or more light sources having emission in the absorption range of the plurality of nanomaterials. In various embodiments, the step 563 of providing one or more light sources can include providing at least one of a UV lamp, a xenon lamp, a halogen lamp, a laser array, a light emitting diode array, and an organic light emitting diode array. The method 500 can also include a step 564 of feeding the media through the fuser subsystem and a step 565 of fixing the toner image onto the media by exposing light using the one or more light sources on the one or more light induced heating elements to heat the one or more light induced heating elements and the fuser subsystem by light absorption by the plurality of nanomaterials.

In various embodiments, the step 565 of fixing the toner image onto the media by exposing light using the one or more light sources on the one or more light induced heating elements to heat the one or more light induced heating elements and the fuser subsystem can include selectively exposing light on a portion of the one or more light induced heating elements to heat a portion of the one or more light induced heating elements and a portion of the fuser subsystem that corresponds to the toner image. In some embodiments, the step 565 can further include selectively exposing light having a first intensity on a first portion of the one or more light induced heating elements to heat the first portion to a first temperature; selectively exposing light having a second intensity different from the first intensity on a second portion of the one or more light induced heating elements to heat the second portion to a second temperature, the second temperature being different from the first temperature; and so on. One of ordinary skill in the art would know that there can be numerous reasons to heat a first portion of the one or more light induced heating elements to a first temperature, a second portion of the one or more light induced heating elements to a second temperature, such as, for example, increasing energy efficiency and improving image quality. The method 500 can further include feeding a media through the fuser subsystem to fix the toner image onto the media, as in step 565.

According to various embodiments, there is a marking method 600 including a step 681 of feeding a media in a marking system, the marking system including a fuser subsystem that produces heat in one or more light induced heating elements by absorption of light by a plurality of plurality of nanomaterials, wherein the nanomaterials are selected from the group consisting of carbon nanotubes and metal nanoshells, the metal nanoshell including a dielectric core and a metal shell over the dielectric core. The marking method 600 can also include providing one or more light sources in close proximity to the one or more light induced heating elements, each of the one or more light sources having emission in the absorption range of the plurality of nanomaterials, as in step 682. In various embodiments, the step 682 of providing one or more light sources can include providing at least one of a UV lamp, a xenon lamp, a halogen lamp, a laser array, a light emitting diode array, and an organic light emitting diode array. In some embodiments, at least one of the one or more light sources can be a digital light source, wherein each light component of the digital light source can be individually addressable. With a digital light source, the one or more light induced heating elements can be a digital heat source. The marking method 600 can further include a step 683 of transferring and fusing an image onto the media by exposing light using the one or more light sources on the one or more light induced heating elements to heat the one or more light induced heating elements and the fuser subsystem that correspond to the toner image. In some embodiments, the step 683 of transferring and fusing an image onto the media by exposing light using the one or more light sources on the one or more light induced heating elements to heat the one or more light induced heating elements and the fuser subsystem can include selectively exposing light on a portion of the one or more light induced heating elements to heat a portion of the one or more light induced heating elements and a portion of the fuser subsystem that corresponds to the toner image. In other embodiments, the step 683 of transferring and fusing an image onto the media by exposing light using the one or more light sources on the one or more light induced heating elements to heat the one or more light induced heating elements and the fuser subsystem that correspond to the toner image can further include selectively exposing light having a first intensity on a first portion of the one or more light induced heating elements to heat the first portion to a first temperature; selectively exposing light having a second intensity different from the first intensity on a second portion of the one or more light induced heating elements to heat the second portion to a second temperature, the second temperature being different from the first temperature; and so on. The marking method 600 can also include a step 684 of transporting the media to a finisher.

Conventional low mass fusing systems usually exhibit axial temperature non-uniformity on the fuser roll due to the relatively higher thermal resistance in the axial direction compared to the radial direction. The axial temperature profile on the fuser roll surface is highly non-uniform with roll surface outside the paper path at a higher temperature. This results in hot offset when long-edge feed paper is run through after many copies of short edge feed paper. In the disclosed fusing scheme, the axial temperatures can be monitored and controlled by dynamically tuning the digital light source output to ensure uniform axial temperature distribution along the fuser roll and pressure roll. For example, less LED power outputs can be delivered outside the paper path where the fuser roll comes in contact with the pressure roll. Axial non-uniformity can be alleviated without employing heat pipe or other materials and devices.

While the invention has been illustrated respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A printing apparatus comprising a fuser subsystem, the fuser subsystem comprising:

one or more light induced heating elements, each of the one or more light induced heating elements comprising a plurality of nanomaterials, wherein the nanomaterials are selected from the group consisting of carbon nanotubes and metal nanoshells; and one or more light sources disposed in close proximity to the one or more light induced heating elements, each of the one or more light sources having an emission in the absorption range of the plurality of nanomaterials and disposed to produce heat in the fuser subsystem by light absorption by the plurality of nanomaterials.

2. The printing apparatus of claim 1, wherein the plurality of nanomaterials comprises one or more of a plurality of single wall carbon nanotubes, a plurality of double wall carbon nanotubes, and a plurality of multiple wall carbon nanotubes.

3. The printing apparatus of claim 1, wherein the light induced heating element comprises a carbon nanotube textile.

4. The printing apparatus of claim 1, wherein the light induced heating element comprises a solvent coatable light absorbing carbon nanotubes layer.

5. The printing apparatus of claim 1, wherein the metal nanoshell comprises a dielectric core and a metal shell disposed over the dielectric core, the metal shell comprising a metal selected from the group consisting of gold, silver, and copper.

6. The printing apparatus of claim 5, wherein the dielectric core is selected from the group consisting silica, titania, and alumina.

7. The printing apparatus of claim 1, wherein fuser subsystem comprises one or more of a fuser roll, a fuser belt, a pressure roll, and a pressure belt.

8. The printing apparatus of claim 7, wherein at least one of the one or more of a fuser belt and a pressure belt comprises a light induced heating element disposed over a substrate, the light induced heating element comprising a plurality of metal nanoshells dispersed in a polymer.

9. The printing apparatus of claim 7, wherein at least one of the one or more of a fuser roll, a fuser belt, a pressure roll, and a pressure belt comprises:

a conformance layer disposed over a substrate;

a light induced heating element layer comprising a plurality of nanomaterials disposed over the conformance layer; and a toner release layer disposed over the light induced heating element layer.

10. The printing apparatus of claim 9, wherein the substrate is selected from the group consisting of aluminum, stainless steel, polyimide, polyphenylene sulfide, polyamide imide, polyketone, polyphthalamide, polyetheretherketone, polyethersulfone, polyetherimide, and polyaryletherketone.

11. The printing apparatus of claim 9, wherein the conformance layer comprises at least one of a silicone rubber, a fluorosilicone, and a fluoroelastomer.

12. The printing apparatus of claim 9, wherein the toner release layer comprises at least one of a silicone, a fluorosilicone, a fluoropolymer, and a fluoroelastomer.

13. The printing apparatus of claim 1, wherein each of the one or more light sources comprises one or more of a UV lamp, a xenon lamp, a halogen lamp, a laser array, a light emitting diode array, and an organic light emitting diode array.

14. The printing apparatus of claim 1, wherein at least one of the one or more light sources is a digital light source, wherein each light component of the digital light source is individually addressable.

15. A method of forming an image comprising:

providing a toner image on a media;

providing a fuser subsystem that produces heat in one or more light induced heating elements by absorption of light by a plurality of nanomaterials, wherein the nanomaterials are selected from the group consisting of carbon nanotubes and metal nanoshells;

providing one or more light sources in close proximity to the one or more light induced heating elements, each of the one or more light sources having emission in the absorption range of the plurality of nanomaterials;

feeding the media through the fuser subsystem; and fixing the toner image onto the media by exposing light using the one or more light sources on the one or more light induced heating elements to heat the one or more light induced heating elements and the fuser subsystem by light absorption by the plurality of nanomaterials.

16. The method of forming an image according to claim 15, wherein the plurality of nanomaterials comprises one or more of a plurality of single wall carbon nanotubes, a plurality of double wall carbon nanotubes, and a plurality of multiple wall carbon nanotubes.

17. The method of forming an image according to claim 15, wherein the step of providing a fuser subsystem comprises providing one or more of a fuser roll, a fuser belt, a pressure roll, and a pressure belt.

18. The method of forming an image according to claim 15, wherein the step of providing one or more light sources comprises providing one or more of a UV lamp, a xenon lamp, a halogen lamp, a laser array, a light emitting diode array, and an organic light emitting diode array.

19. The method of forming an image according to claim 15, wherein the step of fixing the toner image onto the media by exposing light using the one or more light sources on the one or more light induced heating elements to heat the one or more light induced heating elements and the fuser subsystem comprises selectively exposing light on a portion of the one or more light induced heating elements to heat a portion of the one or more light induced heating elements and a portion of the fuser subsystem that corresponds to the toner image.

20. The method of forming an image according to claim 15, wherein the step of fixing the toner image onto the media by exposing light using the one or more light sources on the one or more light induced heating elements to heat the one or more light induced heating elements and the fuser subsystem further comprises: selectively exposing light having a first intensity on a first portion of the one or more light induced heating elements to heat the first portion to a first temperature;

selectively exposing light having a second intensity different from the first intensity on a second portion of the one or more light induced heating elements to heat the second portion to a second temperature, the second temperature being different from the first temperature; and so on.

21. A marking method comprising: feeding a media in a marking system, the marking system comprising a fuser subsystem that produces heat in one or more light induced heating elements by absorption of light by a plurality of nanomaterials, wherein the nanomaterials are selected from the group consisting of carbon nanotubes and metal nanoshells;

providing one or more light sources in close proximity to the one or more light induced heating elements, each of the one or more light sources having emission in the absorption range of the plurality of nanomaterials;

transferring and fusing an image onto the media by exposing light using the one or more light sources on the one or more light induced heating elements to heat the one or more light induced heating elements and the fuser subsystem; and transporting the media to a finisher.

22. The marking method according to claim 21, wherein the plurality of nanomaterials comprises one or more of a plurality of single wall carbon nanotubes, a plurality of double wall carbon nanotubes, and a plurality of multiple wall carbon nanotubes.

23. The marking method according to claim 21, wherein the step of providing one or more light sources comprises providing one or more of a UV lamp, a xenon lamp, a halogen lamp, a laser array, a light emitting diode array, and an organic light emitting diode array.

24. The marking method according to claim 21, wherein the step of transferring and fusing an image onto the media by exposing light using the one or more light sources on the one or more light induced heating elements to heat the one or more light induced heating elements and the fuser subsystem comprises selectively exposing light on a portion of the one or more light induced heating elements to heat a portion of the one or more light induced heating elements and a portion of the fuser subsystem that corresponds to the toner image.

25. The marking method according to claim 21, wherein the step of transferring and fusing an image onto the media by exposing light using the one or more light sources on the one or more light induced heating elements to heat the one or more light induced heating elements and the fuser subsystem further comprises: selectively exposing light having a first intensity on a first portion of the one or more light induced heating elements to heat the first portion to a first temperature; selectively exposing light having a second intensity different from the first intensity on a second portion of the one or more light induced heating elements to heat the second portion to a second temperature, the second temperature being different from the first temperature; and so on.

* * * * *